United States Patent [19]

Schwartzman

[11] 4,218,891

[45] Aug. 26, 1980

[54] COOLING AND HEAT PUMP SYSTEMS AND METHODS

[76] Inventor: Everett H. Schwartzman, 724 Clyoden Rd., Palos Verdes Estates, Calif. 90274

[21] Appl. No.: 908,270

[22] Filed: May 22, 1978

[51] Int. Cl.[2] ..... F25B 1/00; F25B 27/02; F25B 1/06

[52] U.S. Cl. ..... 62/116; 62/238; 62/500

[58] Field of Search ..... 62/116, 500, 501, 5, 62/238 A, 238 C

[56] References Cited

U.S. PATENT DOCUMENTS

| | | | |
|---|---|---|---|
| 2,519,010 | 8/1950 | Zearfoss, Jr. | 62/500 X |
| 3,277,660 | 10/1966 | Kemper et al. | 62/116 |
| 3,385,348 | 5/1968 | Embury | 62/116 X |
| 3,500,897 | 3/1970 | Von Cube | 62/500 X |
| 4,023,946 | 5/1977 | Schwartzman | 62/116 X |

*Primary Examiner*—Lloyd L. King

*Attorney, Agent, or Firm*—Smyth, Pavitt, Siegemund, Jones & Martella

[57] ABSTRACT

A heating and air conditioning system and method involves the use of turbomachinery and a working fluid capable of changing phase at specific temperature and pressure and powered by an external heat source. The pressure of a portion of the working fluid in liquid form is increased and thereafter heated to change phase to a gas for use as a high energy working fluid component which is flowed through the turbo-drive. Another portion of the working fluid, at an intermediate pressure is expanded to a lower pressure and then passed through an evaporator, whose output forms a low energy working fluid component in gas form. The low energy working fluid is flowed into the turbo-device for admixture with the high energy working fluid, to effect an energy exchange therebetween. The turbo-device includes an output which is condensed and at an intermediate pressure. Various systems, turbo-devices and working fluids are described.

30 Claims, 11 Drawing Figures

COOLING AND HEAT PUMP SYSTEMS AND METHODS

REFERENCE TO RELATED APPLICATIONS

The present invention relates in part and uses equipment of the type described and claimed in my U.S. Pat. Application Ser. No. 875,115 filed Feb. 3, 1978, whose disclosure is incorporated herein by reference.

BACKGROUND OF THE INVENTION

The present invention relates to heating and cooling systems, more particularly to an improved heating and cooling system and method using rotating turbomachinery.

In many heat powered cycles, such as for cooling and heating, reciprocating types of equipment are used e.g., piston type pumps and compressors. In such cases, especially for cooling systems such as vehicular air conditioning, a compressor driven by a motor is used because the system cost is cheaper. The use of piston type equipment usually requires different fluids, especially for lubrication of the reciprocating equipment, and the presence of different fluids sometimes creates problems in the system. Present reciprocating systems require a shaft seal which is subject to leakage thus releasing the working fluid, e.g., hologenated hydrocarbon, into the atmosphere.

The use of heat as the power source has not received attention and use because of the fact that when heat is used as the power source, there is the requirement for a substantial number of reciprocating parts in the system and both the number of parts and lubrication requirements create problems of reliablity and systems efficiency, even though the cost of operation is less. Where there have been attempts to use heat power for cooling and heating, reciprocating equipment has generally been used. In recent years, with the costs of energy rising, cost of equipment has been less of a consideration if there can be a savings in energy.

In the case of vehicular cooling systems, the fuel energy needed to drive the systems has become a factor because of fuel costs. Thus, heat powered cooling systems, especially those powered by waste heat such as hot engine exhaust gases, have become more attractive, providing the system is sufficiently efficient to provide the needed cooling, provided the cost of the system is economically attractive.

It is also desirable to provide a system which may be used as both a cooling system and a heat pump such that the system may be adapted for residential uses as a heat pump in the cool seasons and as a cooling system in the warmer seasons. Typically, hydrocarbon gases may be used as the primary power source with a heat pump system as a heating package or as a cooling unit. In some portions of the country, part or all of the power may be solar power for both heating and cooling.

There are advantages in the use of rotating equipment such as turbomachinery in cooling and heating systems, such as fewer parts and substantial reduction in lubrication problems and reduction in possible contamination of heat exchanger surfaces by the lubricant. Also the number of moving parts is reduced and rotating equipment traditionally is more reliable than reciprocating equipment.

SUMMARY OF THE INVENTION

The system and method of the present invention, which may be used either as a cooling system or heating system, by use of an appropriate external heat source is composed principally of rotating equipment in the form of turbomachinery of the type described in the above identified application. While the primary purpose of the present invention is in cooling, refrigeration and freezer applications, with minor additions, as described, the same system may be used as a heater (heat pump). Thus, the fluid used as the system working fluid may be used for lubrication thereby eliminating the possibility of contamination of heat exchanger surfaces. Since rotating machinery is used, the system is generally a high volume and low pressure system in comparison with reciprocating types of equipment of comparable capacity. The use of rotating equipment also offers the advantage of longer bearing life because, in comparison to reciprocating equipment, there are no large cyclic bearing loads.

Other advantages of the present invention are small size for the system and a fully closed system which is not driven by any coupling or connection to an external prime power source. Moreover, the system is more reliable in that the major component of the moving machinery is a turbine-compressor type of device.

Thus, the system of the present invention includes a tank for a working fluid that changes phase, e.g., at a pre-determined temperature. Working fluid in liquid form is flowed through an expansion device to reduce the pressure of the fluid which then flows to an evaporator for change of phase to a gas. Liquid from the tank is flowed through a pump which increases the pressure thereof, the pressurized liquid then flowing through a heat exchanger powered by the external heat source to change the phase of the pressurized liquid to a gas.

The gas from the evaporator and the high pressure gases from the heat exchanger are flowed to a turbo-device, of the type described in said application, comprised of a compressor-ejector and turbine. The output of said turbo device is flowed through a condenser to effect a change of phase to a liquid for return to the tank.

When used as a cooler, refrigeration or freezing system, air to be cooled is passed through the evaporator and forms the cooled air mass while air flowing through the condenser is heated to effect the change of phase of a major portion of working fluid from a gas to a liquid. Heat is supplied to the heat exchanger from any heat source, e.g., waste engine heat, heat from a burner or solar heat, and the like, as will be discussed in detail.

Where used as a space heater, "cold" heat from the outside is passed through the evaporator while the condenser has air flowed through it to heat the air which is then used as the heated air source. The external heat may, again, be solar, waste heat or heat from a burner.

In one form, a regenerator is used to preheat the working fluid in liquid form from the pump while cooling the working fluid in gas form exhausting from the turbo-device prior to flow into the condenser.

Other systems include those in which there is a preheater for the working fluid entering the compressor portion of the turbo-device and a multi-stage turbo-device as well as a system which is both a Brayton and Rankine cycle.

Other advantages, modes and uses will be readily understood by those skilled in the art after they have read the following detailed description and referred to the accompanying drawings which illustrate what are considered to be preferred forms of the present invention as set forth in the appended claims.

DETAILED DESCRIPTION

Figure 1:
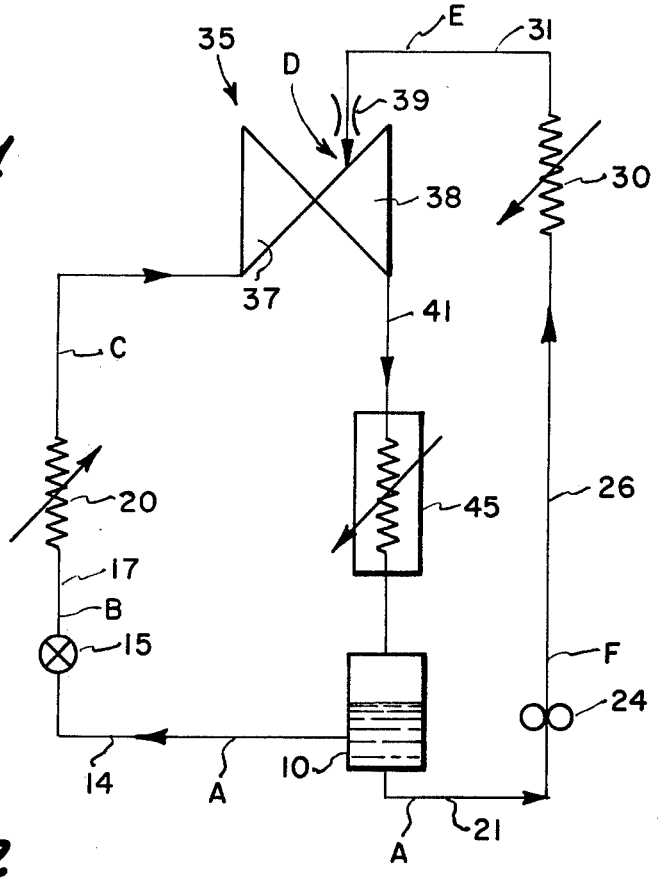
FIG. 1 is a schematic diagram of a cooling system of the present invention.

Referring to the drawings which illustrate a preferred form of the present invention, the system of FIG. 1 includes a tank 10 that contains a working fluid that changes phase at a predetermined temperature. Typical working fluids are halogenated hydrocarbons such as those available under the trademark FREON. As is known in the art the composition of the products vary, some containing both chlorine and flourine and others containing only flourine. It is desired to use those hologenated hydrocarbons which will not have any adverse ecological effects, i.e., ozone layer impairment. Even though the system of the present invention is a closed loop, escape of certain types of halogenated hydrocarbons is undesirable.

The preferred working fluid is one which provides a substantial volume of gas upon change of phase from a liquid especially for small capacity equipment and one which is stable at elevated temperatures, e.g., 300° to 700° F., or at least one which does not substantially decompose in a short period when exposed to elevated temperatures. Typical such materials are Freon C318, 114, 22 and 12, the 22 and 12 materials being suitable for large capacity equipment. Other materials which may be used are mixtures of carbon dioxide and hydrocarbon gases such as butane, propane, etc.

The major portion of the working fluid is the tank is in liquid form and under an intermediate pressure. Connected to the tank 10, through line 14 is an expansion device 15 such as a Joule-Thompson valve. This type of valve is preferred for small capacity equipment from an economics and reliability standpoint, although for larger systems a turbine may be used. The expansion device 15 operates to reduce the pressure of the fluid flowing therethrough at constant enthalpy. Thus, the output of the device 15 is liquid at reduced pressure and temperature compared to the input.

Connected to the device 15 through line 17 is an evaporator 20 through which the working fluid flows, the input being predominately a liquid and the output being a gas. Air flows over or through the evaporator 20 and is cooled while the liquid is heated to change phase to a gas, the output of the evaporator being a gas at relatively low pressure.

Also connected to the tank 10 through line 21 is a pump 24 which receives working fluid in liquid form and increases the pressure thereof, the output of the pump being a liquid at relatively high pressure. Connected through line 26 to receive the output of the pump 24 is a heat exchanger 30 through which heat is applied to the working fluid at elevated pressure to effect a change of phase to a gas at high pressure, the output of the heat exchanger being working fluid at high temperature and high pressure.

The heat exchanger 30 uses an external heat source which may be of a variety of types, e.g., hot gas engine exhaust, directly fired from a combuster or burner, solar heat, waste heat from chemical and power plants, geothermal energy and the like. Thus, the external heat is used to effect the change of phase in the heat exchanger 30 and the output, through line 31 is used with a turbo-device 35.

The turbo-device 35, which is a turbo machine as described in the above identified application, includes a compressor portion 37, a turbine portion 38 and an ejector portion 39. Low pressure gas is introduced into the turbo-device 35 as well as high pressure high temperature gas. In the form illustrated in FIG. 1, the low pressure gas is the output of the evaporator which enters the compressor portion 37. The high temperature high pressure gas from the heat exchanger 30 enters the ejector portion 39 and the combined flows passes through the turbine portion 38 and exits the device 35 via output 41. In the passage through the turbo-device 35, the pressure of the low pressure fluid is increased by the energy exchange with the high pressure high temperature gas entering the ejector portion.

Connected to line 41 to receive the output of the turbo-device is a condenser 45 such that the working fluid in gaseous form and at a pressure intermediate that the ejector inlet and compressor inlet is cooled to a liquid state by flow of cooling fluid, e.g., air, which in turn is heated. The condensed working fluid liquid then flows into the tank 10.

It can be seen from the above description of the system of FIG. 1 that the system is completely closed and powered from an external heat source. Cooling is accomplished by the air flow of fluid through the evaporator while heat is given up by the fluid in the condenser which operates to heat the fluid flowing over or through the condenser. Operated as a cooling system, the evaporator would be located within the structure to be cooled while the condenser would be located such that fluid flowing over or through it is discharged outside of the structure to be cooled.

Figure 2:
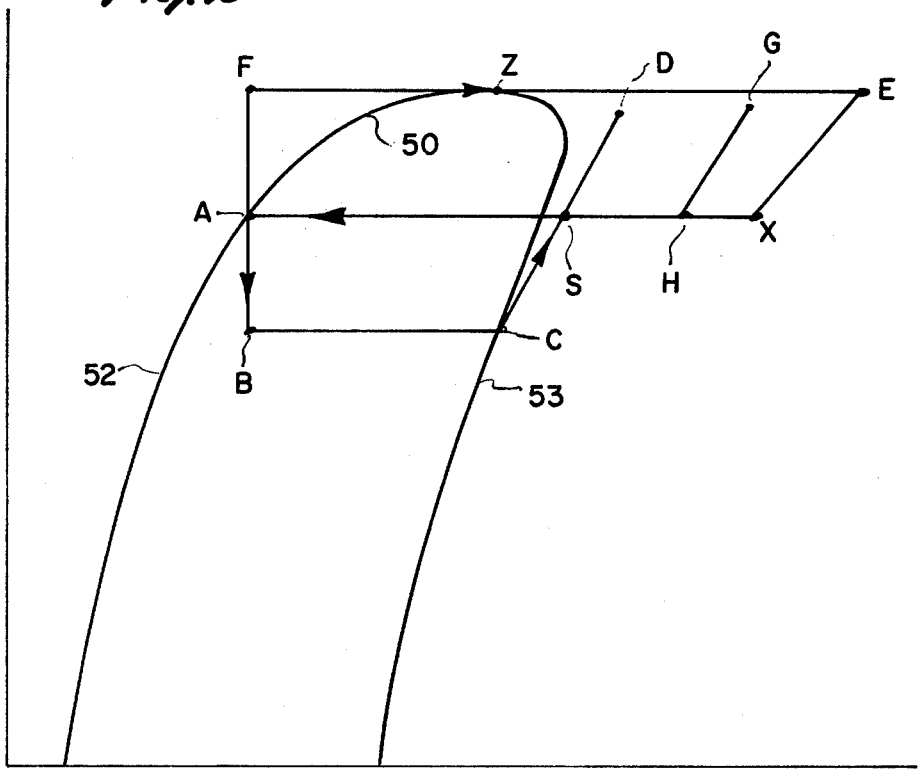
FIG. 2 is a pressure-enthalpy diagram for use with the system of FIG. 1.

Referring now to FIG. 2, a pressure entholpy diagram, the thermodynamics of the system of FIG. 1 may be better understood. For convenience, the letter references in FIG. 2 have been correlated to the system of FIG. 1, for purposes of explanation. Again, for purposes of explanation, the diagram of FIG. 2 is for Freon 12 and includes the "dome" area 50 with the saturated liquid line 52 and the saturated vapor line 53, as shown. Relative pressure in pounds per square inch absolute is plotted along the ordinate and enthalpy in terms of BTU per pound above the saturated liquid at −40° F. is plotted along the abscissa. For simplicity, many of the constant temperature, pressure and entropy lines have been omitted.

Thus, A represents the thermodynamic condition of state of the liquid in the tank 10, i.e., temperature of about 130° F. and pressure of about 190 psia. Expansion through the expansion device 15 is represented by the line AB with B representing the thermodynamic state prior to entry into the evaporator 20. Accordingly, it can been seen that the enthalpy remains constant while the temperature drops to about 50° F. with the working fluid having the composition indicated at B, i.e., mostly saturated liquid with a small amount of gas. As the working fluid flows through the evaporator, represented by B to C, the working fluid changes phase to a gas as indicated by C which is on the saturated line 53, without any change in pressure, but with an increase in enthalpy.

Point D of FIG. 2 represents the total enthalpy through the compresser portion of the turbo-device and is composed of the static pressure and the dynamic head (kinematic energy due to velocity). Point E represents the total enthalpy in the fluid entering the ejector portion 39 of the turbo-device 35 at the inlet of the ejector. In practice, point E is achieved by pumping the liquid by pump 24, represented in FIG. 2 as A to F from 190 psia to 600 psia, with no appreciable change in enthalpy. As shown, the liquid being pumped is in the super cooled region. The next sequence, F to E, is achieved by heating the liquid in the heat exchanger 30, thus increasing the enthalpy substantially while achieving a change of phase to a gas at a constant pressure.

Thermodynamically, as explained in detail in the above identified application, the combining and flow of fluids through the turbo-device 35 is analogous to a typical ejector, i.e., the required ejector input fluid is expanded to the required static pressure, the latter primarily a system consideration. During the expansion there is an increase in velocity of the fluid (the spouting velocity of the ejector $V_j$) and a corresponding drop in pressure. Like wise, the rotating compressor wheel imparts a tangential velocity ($V_u$) to the fluid. When the compressor fluid is admixed with the ejector fluid, the velocity is $V_e$.

Point S represents the desired exhaust pressure of the compressor and in terms of required enthalpy input just due to the static pressure increase is represented by $\Delta h_{s\text{-}c}$. Due to the rotation of the wheel, the fluid has an increase in energy because of its tangential velocity. The total amount of energy required is the sum of the energies, that is, the energy to increase the static pressure and that due to the kinematic energy ($\Delta h_{d\text{-}s}$) of the fluid because of its tangintial velocity. Thus the total energy of the compressor fluid may be expressed as $\Delta h_{d\text{-}c}=\Delta h_{s\text{-}c}+\Delta h_{d\text{-}s}$.

Next, $V_j$ (the spouting velocity of the ejector) is obtained from the expansion of the fluid at constant entropy, and is represented by the formula: $V_j=\sqrt{2g\Delta h_{e\text{-}x}}$ where $\Delta h_{e\text{-}x}$ is equal to the change in enthalpy from E to X.

When the fluids are united (conserving momentum) the resulting velocity $V_e$ is obtained as a function of mass flow ratios. The $V_e$ may be calculated using incompressible fluid theory from the formula $V_e=[1+mV]/[1+m]\ V_j$, where m is the mass flow through the compressor wheel divided by the mass flow through the ejector and V is the tangential velocity ($V_u$) at the compressor wheel divided by $V_j$. In the case of compressible fluids the analysis may be carried out as described by Keenan et al., *Journal of Applied Mechanics,* September 1950, pp. 299–309.

The total energy of the mixed ejector and compressor fluids is represented by point G and is comprised of the enthalpy due to its static pressure and temperature at H plus the kinematic energy represented by $\Delta h_{g\text{-}h}$ which is equal to $V_e^2/2_g$. Due to conservation of work principle, the required input work of the compressor times its mass flow divided (because more work is required as a function of efficiency) by the compressor efficiency must equal to the output work of the turbine times the mass flow through the turbine times turbine efficiency (because the output obtained is a direct function of the efficiency). Thus, the work required by the compressor has to equal to work output of the turbine and may be expressed as $$\Delta h_{d-c}\, m_c/\text{compressor efficiency} = (V_e{}^2/2_g)\,(m_c + m_j)\ (\text{efficiency of turbine})$$

where $m_c$ is mass flow through the compressor and $m_j$ equals the mass flow through the ejector. From this relationship for any turbine and compressor efficiency, the required mass flow ratios maybe determined.

System considerations fix the static pressure requirements of S, H and X. For example, if 130° F. condensing temperature is required, for example, for Freon 12, 190 psia static pressure is needed for condenser operation, as represented by S to A.

Thus, to review, A to B is the expansion means operation; B to C is the evaporator; C to D is the compresser portion; E to X is the ejector portion; G to H is work output of the turbine portion, and is related to ejector performance and compressor requirement; A to F is the pump; F to E is the heat exchanger, and S to A is the condenser.

Figure 3:
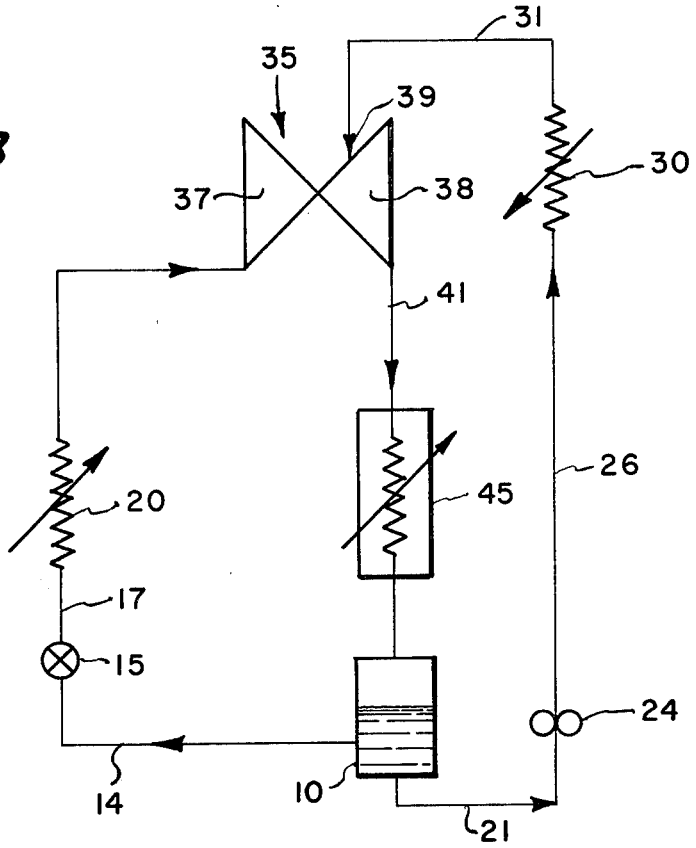
FIG. 3 is a schematic diagram of the system shown in FIG. 1 and used as a heating system.

Referring now to FIG. 3 wherein like numbers have been used as in FIG. 1, the operation of the system as a heat pump is shown. In this form, the difference from FIG. 1 is that the condenser 45 is located such that air to be heated is passed over or through the condenser and used as the heated air for space heating. The evaporator 20 is located such that outside air is passed over or through it and cooled thus adding heat to the system, and is discharged outside of the area to be heated. Thus, FIGS. 1 and 3 represent the same basic equipment and with appropriate controls and/or ducting can be used as a heating system in cold weather and as air conditioning system in warmer weather.

Figure 4:
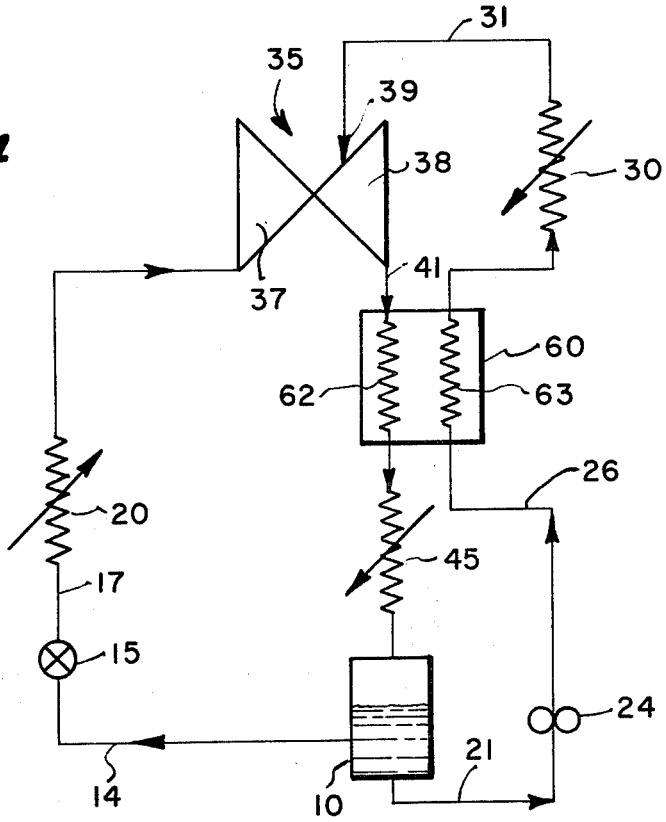
FIG. 4 is a diagram of a system similar to that of FIGS. 1 and 3 illustrating the use of a regenerator.

The system illustrated in FIG. 4 is similar to that of FIGS. 1 and 2 except that a regenerator heat exchange 60 is used including a pass 62 and a pass 63. The input to pass 62 is the hot gas exchange from the turbo-device 35, the output of that pass being the input to the condenser 45. The input of the second pass 63 is the output of the high pressure pump, the output of that pass going to heat exchanger 30. By use of a regenerator heat exchanger, the working fluid in liquid form is heated while the gas from the turbo-device is cooled prior to flow into the condenser 45. The output of pass 63 of regenerator 60 may be partly liquid and part gas or all gas.

Figure 5:
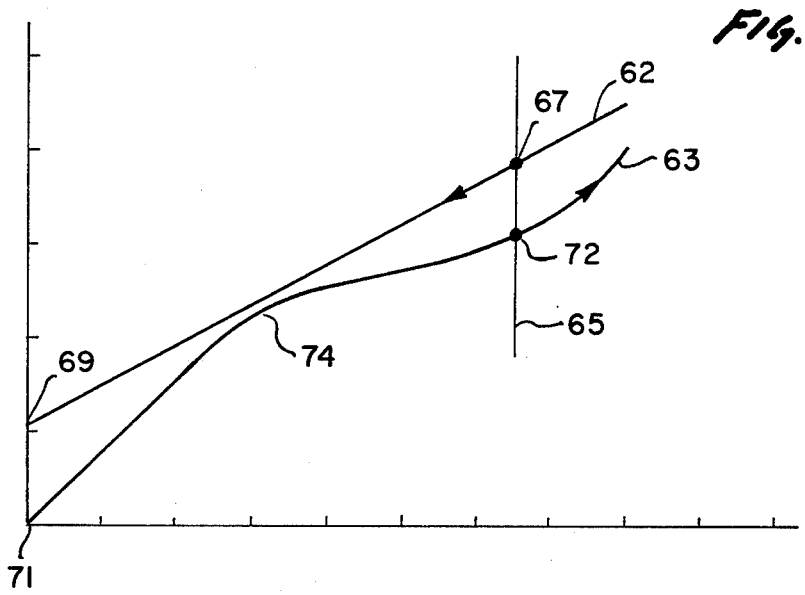
FIG. 5 is a diagram showing the general performance of the regenerator of FIG. 4.

Referring to FIGS. 5 and 2, the operation of the regenerator heat exchanger may be understood. On FIG. 5, the ordinate is fluid temperature in °F. and the abscissa is Q (in BTU) representing the amount of heat transferred from one fluid to another. Curve 62 represents the condition of the hot gas leaving the turbo-device and flowing in pass 62 which curve 63 represents the liquid from pump 24 which flows through pass 63 of the regenerator. The vertical line 65 is related to the length of the regenerator.

Thus, hot gas at temperature $T_1$ entering pass 62 at point 67 is cooled to temperature $T_2$ as it reaches point 69. Point 67 and 69 represent, respectively, points H and S of FIG. 2, indicating that there has been a reduction in temperature, a change in enthalpy at constant pressure. The pressurized fluid entering pass 63 at point 71 is heated from $T_3$ to $T_4$ and exits at point 72. Points 71 and 72 represent, respectively, points F and Z of FIG. 2 indicating an increase in temperature, a change in enthalpy at a constant pressure. The curve 63 also shows the region 74 which approaches but does not "pinch-off".

To illustrate the effect of the use of a regenerator and using as an example an air conditioning system for a vehicle, such as an automobile or truck cab, the waste heat from an internal combustion engine is between 800° F. and 1200° F. on the average, i.e., about 900° F. for a diesel engine and about 1400° F. for a gasoline engine. The required horse power output of the engine for 3 tons of air conditioning for a diesel engine without regeneration is 18 and with regeneration is 12; for a gasoline engine without regeneration the horse power is 15.15 and with regeneration is 9.13, all on a calculated basis. These data provide some basis for comparison of the system with and without a regenerator.

Figure 6:
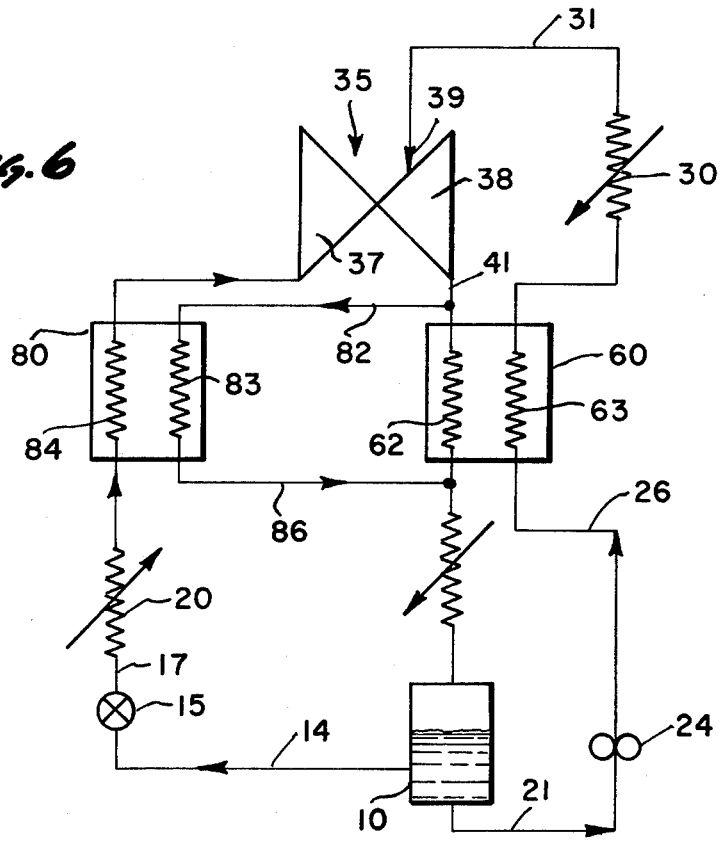
FIG. 6 is a schematic diagram of a system similar to that of FIG. 5 showing the use of a pre-heater.

The system of FIG. 6 is similar to that of FIG. 4 but illustrates the use of a compressor pre-heater 80, the remainder of the system being identified by like reference numerals for like components. In this system a portion 82 of the output of the turbo-device 35 is used as a high temperature inlet to one pass 83 of the pre-heater 80 while the balance of the output through line 41 flows into pass 62 of the regenerator 60 and forms the hot gas side of the regenerator. The other pass 84 of the pre-heater 80 receives the output of the evaporator 20, the output of which forms the input as a gas to the compressor portion 37 of the turbo-device 35. The output of pass 83 is flowed through line 86 to join the output of pass 62 to the input of the condensor 45. Thus, the compressor pre-heater takes a portion of the output of the turbo-device to preheat the output of the evaporator which forms the input to the compressor portion.

Normally, adding heat to the input of a compressor is not advantageous because the higher temperature of the fluid input to the compressor requires more work by the compressor to compress the fluid to the same output level as when the compressor input fluid was cooler. Thus, the usual procedure is to keep the temperature of the fluid input as low as reasonably possible.

By the present invention, the temperature of fluid input is increased by the pre-heater because in some systems where a regenerator is used and where there is a change in phase of the fluid, and due to the peculiarities associated with change of phase (large changes in apparent specific heat) there may be system advantages in preheating of the fluid prior to the compressor portion. One such advantage is the reduced possibility of "pinch-off" in the regenerator by increasing the temperature of the exhaust from the turbine which forms the inlet of the high temperature side of the regenerator. In effect, referring to FIG. 5, the two curves 62 and 63 are moved apart such that bulge 74 is spaced further away from curve 62. The result may be better overall system performance by use of a pre-heated fluid to the compressor portion.

Figure 7:
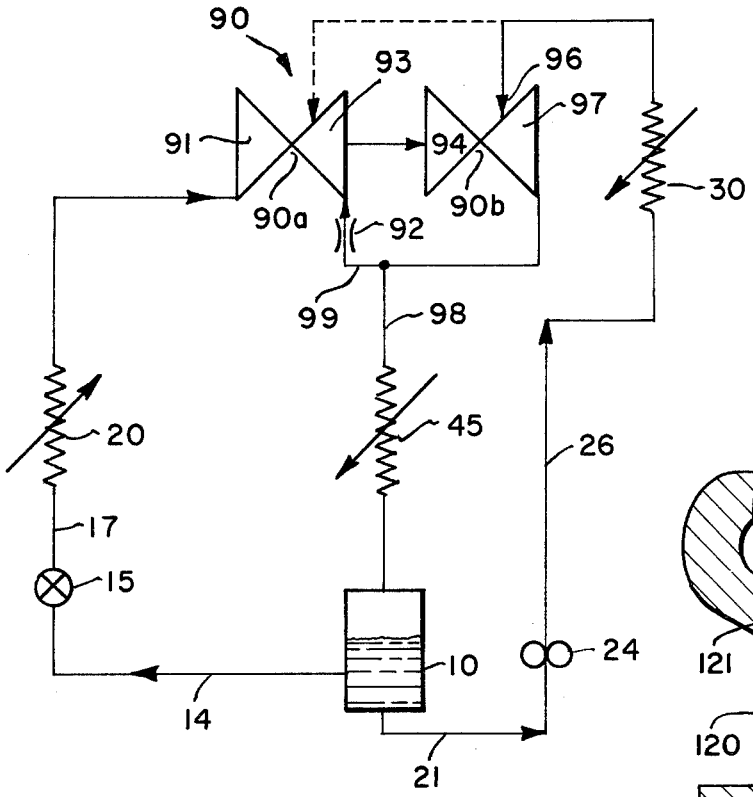
FIG. 7 is a schematic diagram of a system using a multiple stage turbo-device.

Referring now to FIG. 7, wherein the same reference numerals have been used for the same elements, a multi-stage turbo-device 90 is used. Such a multi-stage device offers certain advantages, for example, it permits optimum rotating machinery design and performance, the rotating machinery may operate at a lower speed, or there are reduced losses because of reduced mach number effects by a lower head increase or pressure ratio in each stage. Also, there is more flow in the second and subsequent stages.

For purposes of explanation, the multi-stage device 90 is shown as a dual stage turbo-device including a first stage **90*a* including a compressor portion 91 receiving flow from the evaporator 20, an ejector portion 92 and a turbine portion 93. The second stage, 90*b* likewise includes a compressor portion 94, an ejector portion 96 and a turbine portion 97. As shown, the output of the first stage (from the turbine portion 93) is the in-feed flow for the compressor portion 94 of the second stage. The output of the second stage (flow from turbine portion 97) is split and a portion 98 flows to the condenser 45 and the remaining portion 99 flows to the ejector portion 92** of the first stage.

In the form shown, the output of high pressure high temperature gas from the heat exchanger 30 is the input to the ejector portion 96 of the second stage. Alternatively, as shown in dotted lines, a portion of the output of the heat exchanger 30 may be used as a portion of the fluid to the ejector portion of the first stage. Optionally, a regenerator, as described, may be used in the line upstream of the condenser 45 to pre-heat the working fluid prior to entry into the heat exchanger 30, as described.

Figure 8:
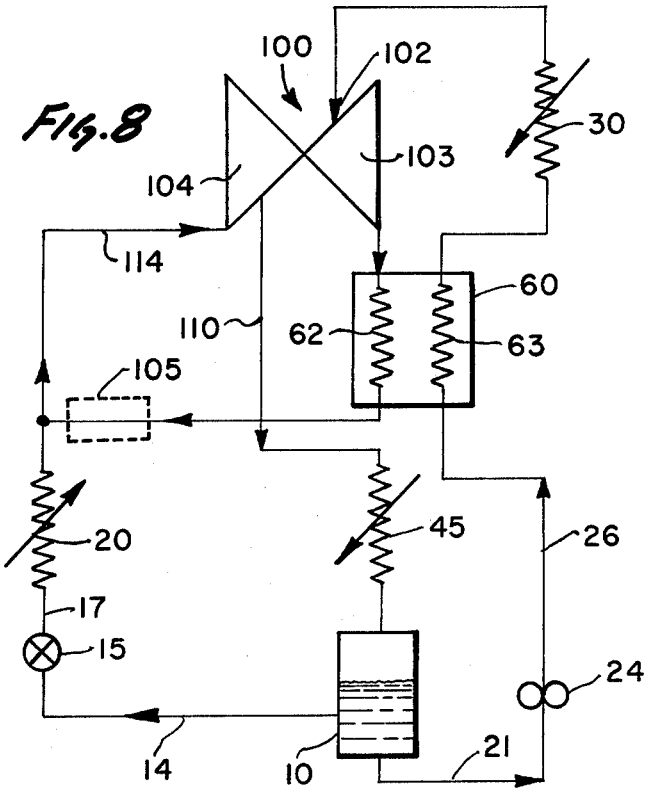
FIG. 8 is a schematic diagram of a system of the present invention which is partly a Brayton and partly a Rankine cycle.

The system of FIG. 8, wherein like reference numerals have been used where applicable, includes portions forming a Brayton cycle and portions forming a Rankine cycle as well as a modified form of turbo-drive 100. This particular system offers the advantage of increased flow through the compressor portion by feeding the exhaust of the turbine portion into the compressor. The output of the turbine portion is exhausted to evaporator pressure thus increasing the available head to be used by the turbine portion. Also, the total pressure head (static and kinematic) from the compressor portion is available so that the fluid entering the condenser is at the proper pressure. The result is a lower compressor wheel speed so that the optimum specific speed and specific diameter may be attained.

Thus, referring to FIG. 8, the high pressure high temperature working fluid in gas form enters the ejector portion 102 of the turbo-device 100 and the exhaust from the turbine portion 103, at the pressure of the evaporators, enters pass 62 of the regenerator 60 where it is cooled and operates to heat the liquid in pass 63. The output of pass 62 flows to the output of the evaporator 20, the mixed stream forming the input to the compressor portion 104. Thus, the exhaust of the turbine portion is fed into the compressor portion. If needed, an axiliary cooler 105 may be used to reduce further the temperature of the turbine portion exhaust flowing from pass 62 and into the compressor portion. Alternatively, where system efficiency is not an overriding consideration in comparison to system cost and available heat energy, e.g., hot gas exhaust from vehicles, the regenerator 60 may be omitted and the cooler 105 retained. As shown, the compressor portion 104 includes an output 110 at the desired intermediate pressure for flow through the condensor at condenser pressure.

The system of FIG. 8 includes both a Rankine cycle and a Brayton cycle the components which are part of the Rankine cycle (compound of a change of phase fluid) usually involves a pump, boiler (heat exchanger), expander, and condenser. The Brayton cycle (no change of phase and in gas form) involves the compressor expander and cooler and heater. In FIG. 8, a portion of the regenerator is a cooler for the Brayton cycle and another portion is a heater for the Rankine cycle.

Figure 9:
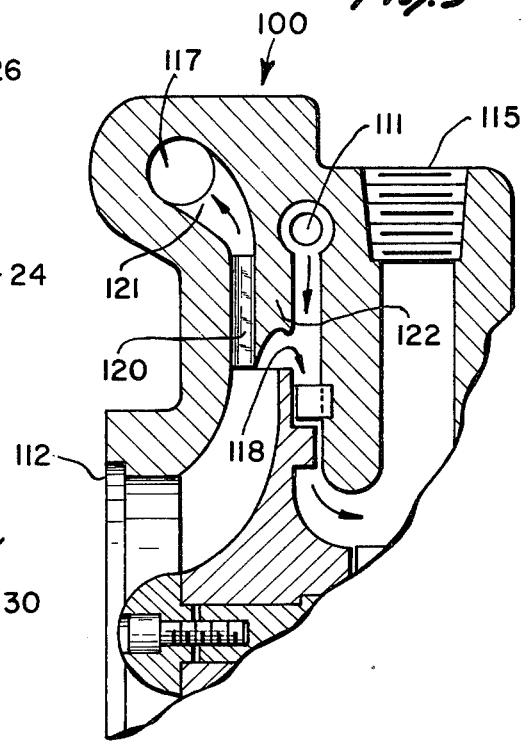
FIG. 9 is a diagrammatic view of the turbo-device used in the system of FIG. 8.

The output from the compressor portion may be obtained by a diffuser of suitable design in the compressor of the turbo-drive. For example, FIG. 9 shows a portion of the turbo-device 100 including the ejector inlet 111 connected to line 102, the compressor inlet 112 receiving the flow from line 114, the turbine outlet 115 for flow into pass 62 of regenerator 60, and a compressor exhaust port 117 connected to line 110.

Cooperating with the compressor blades 118 are a plurality of diffuser vane 120 located in a collector 121 which communicates with the exhaust 117. Between the collector 121 and ejector is a oplitter 122. The plurality of diffuser names 120 are arranged preferably symmetrically around the compressor blades, in an annulus, such that each diffuser vane takes the same incrimental flow for passage into the collector and out the exhaust. The diffuser vanes operate to convert the kinetic head into total head, the latter comprised of the static head and the kinemetric head.

Figure 10:
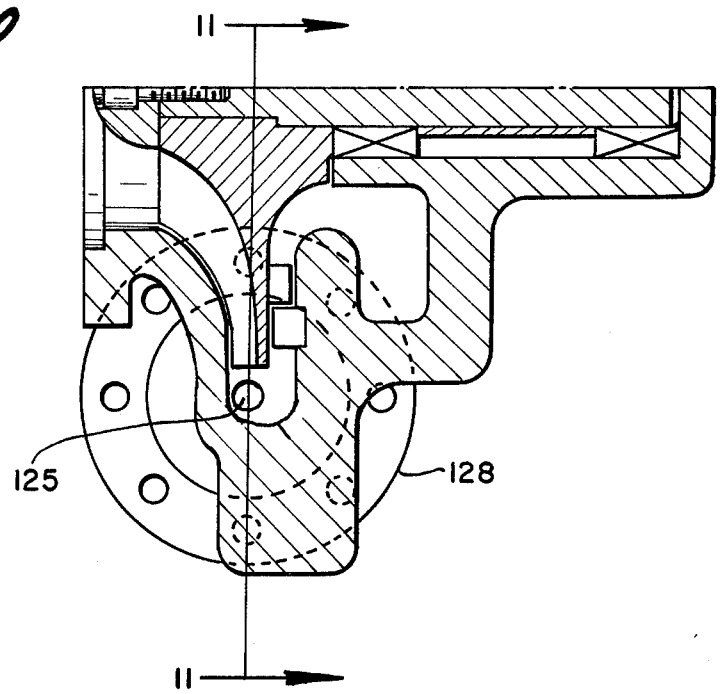
FIG. 10 is a diagramatic view of another form of turbo device for use in the system of FIG. 8.
Figure 11:
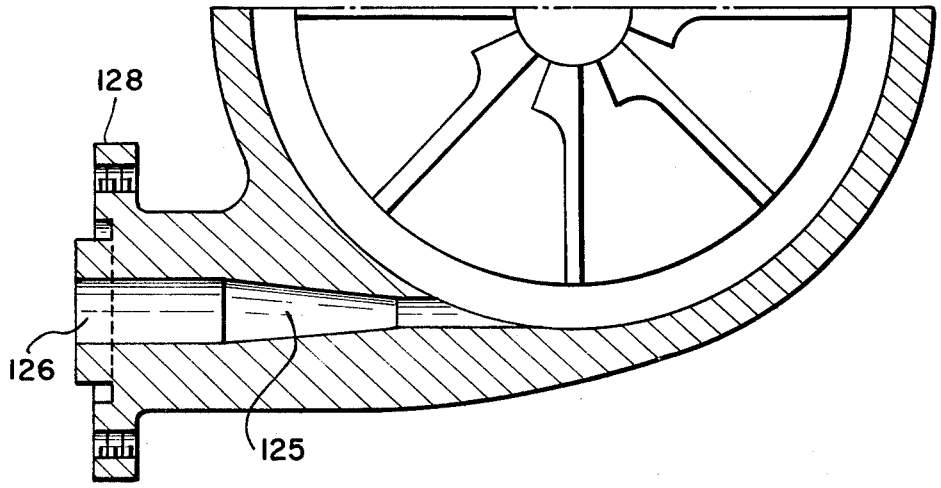
FIG. 11 is a view partly in section and partly in elevation taken along the line 11—11 of FIG. 10.

Another form of diffuser which may be used is shown in FIGS. 10 and 11. In this form a conical diffuser 125 is shown, there being a single such diffuser which performs the function of the diffuser vanes but operates by removing from one general location a portion of the compressor flows. As shown, the outlet 126 terminates in a flange 128 for attachment to the line 110. Since the fluid from the ejector expands, it is at the same static pressure as the compressor output flow, thus in each of the structures shown in FIGS. 9 and 10 there is no back flow of fluid from the ejector through the diffuser.

By way of example and not to be construed as a limitation on the present invention and using Freon 12 as a working fluid, the system paramatus of the present invention involve a pump which elevates the pressure from 190 psia to 600 psia. The heat exchanger elevates the temperature of the working fluid to about 400° F. at 600 psia which forms the high energy fluid for the turbo-device. The expansion means permits the pressure to drop from 190 psia to about 50 to 55 psia and flow through the evaporator effects a change of phase to a gas at 50 to 55 psia at about 45° F. and forms the working fluid low energy component. The output of the turbo-device is at an intermediate pressure and in gas form which then undergoes a change of phase to a liquid, at intermediate pressure, in the condenser.

For Freon C318, the input pressure of the pump is 110 psia and the output is 500 psia, while the heat exchanger elevates the temperature to 500° F. at 500 psia. The expansion means permit the pressure to drop from 110 psia to about 24 psia, and flow through the evaporator effects change of phase to a gas at 24 psia and 45° F.

As will be apparent to those skilled in the art, use of other working fluids may effect the exact level of temperature and pressures, and may effect flow rates and the like to bring the system into balance. The various florms of systems each include equipment and approaches from which one skilled in the art may modify or alter the specifics of the system, recognizing that the turbo-devices, as herein described, offers the advantage of an efficient rotating type of equipment which renders the various systems attractive from both an energy consumption view point and from a cost and performance standpoint.

It will also be apparent to those skilled in the art that pressure-enthalpy diagrams and an understanding of pressure-enthalpy diagrams is important in system design and parameters, when considered with the design of the turbo-device, to assure compliance with the relevant thermodynamic factors in the design of a system embodying the present invention.

As far as the specific design of the turbo-device, reference is made to the application above identified. It should be understood, however, that one of the advantages of the present invention is that rotating machinery of the type therein described, due to the efficiency thereof, renders the overall system efficiency attractive especially in smaller type systems, although the present invention is not limited to small types of systems. For larger capacity systems, the advantages of the present invention include reduction in equipment size and acceptable efficiency with the reliability of rotating machinery.

Typically, for the smaller capacity equipment the turbo-device may have a blad or wheel diameter of one inch and greater and operating at an rpm of 50,000 to about 400,000 rpm. Again, the general parameters for turbo-machinery design and performance will become apparent to those skilled in the art with reference to the above identified application.

Also, an advantage of the present invention is the fact that the working fluid may be used for the bearings of the turbo-device, either as a high pressure gas or liquid bearing system, as is known in the art, thus avoiding possible contamination of the working fluid. Also, the present system is a hermetically sealed unit with no leakage of the working fluid.

It will also be apparent to those skilled in the art that various changes, modifications and alterations of the system and method may be made, following the various teachings herein without departing from the scope of the appended claims.

I claim:

1. A system of the type described for use in heating and cooling in which at least a portion of the power is from an external source of heat comprising:

a supply of working fluid which changes phase at a predetermined temperature, a major portion of said working fluid in said supply being in liquid form;

expansion means connected to receive at least a portion of the liquid from said supply for reducing the pressure thereof;

evaporator means receiving said working fluid in liquid form from said expansion means and operative to effect a change of phase of at least a portion of said working fluid to a gaseous phase;

pump means connected to receive working fluid from said supply in liquid form and to increase the pressure thereof;

heat exchanger means powered by said external source of heat and operative to receive high pressure working fluid to effect a change of phase thereof to a high pressure gas;

turbo-machinery means including a compressor portion and a cooperating turbine portion and an ejector portion;

said compressor portion receiving at least a portion of the working fluid in gaseous form from said evaporator means for flow of at least a portion thereof into said turbine portion;

said ejector portion receiving high pressure gas from said heater means for admixture with at least a portion of the gaseous flow through said compressor for flow through said turbine portion; and condenser means connected to receive at least a portion of the output of said working fluid in gaseous form from said turbo machinery means to effect a change of phase of at least a portion thereof to a liquid for flow to said supply means.

2. The system as set forth in claim 1 in which air is flowed through said evaporator to reduce the temperature of said air for refrigeration and cooling purposes.

3. The system as set forth in claim 1 in which air is flowed through said condenser to increase the temperature of said air for heating purposes.

4. The system as set forth in claim 1 wherein said expansion means is a Joule-Thompson valve.

5. The system as set forth in claim 1 wherein said expansion means is a pressure reducing device operating at constant enthalpy.

6. The system as set forth in claim 1 wherein said working fluid is a halogenated hydrocarbon.

7. The system as set forth in claim 1 wherein said working fluid is a mixture of carbon dioxide and a hydrocarbon.

8. The system as set forth in claim 1 wherein said external source of heat is waste heat.

9. The system as set forth in claim 1 wherein said heat exchanger means is a boiler.

10. The system as set forth in claim 8 wherein said external source of heat is waste heat from an internal combustion engine.

11. The system as set forth in claim 1 further including regenerative heat exchanger means, said regenerative heat exchanger including one pass connected to receiving working fluid in liquid form from said pump and connected to provide preheated working fluid for flow into said heat exchanger means, the other pass of said regenerative heat exchanger being connected to receive at least a portion of the output of said turbomachinery device for passage therethrough, at least a portion of the flow through said other pass flowing through said condenser.

12. The system as set forth in claim 1 further including compressor pre-heating means receiving a portion of the discharge from said turbomachinery for pre-heating the working fluid entering the compressor portion of said turbomachinery.

13. The system as set forth in claim 1 wherein said turbomachinery includes at least a multi-stage turbo-device, means interconnecting the output of the turbine portion of one stage to the compressor portion of the succeeding stage, and means connecting at least a portion of the output of the turbine portion of a succeeding stage to the ejector portion of the previous stage.

14. The system as set forth in claim 13 further including means to flow at least a portion of the working fluid from said heat exchanger to the ejector portion of at least one of said stages of said turbo-device.

15. The system as set forth in claim 1 wherein the turbomachinery means includes means cooperating with the compressor portion to remove a portion of the working fluid therefrom for flow to said condenser, and means to flow the output of said turbine portion to the working fluid from said evaporator for flow thereof into said compression portion.

16. A system as set forth in claim 10 further including a regenerator having one pass connected to receive working fluid from said pump for flow to said heat exchanger and a second pass connected to receive the exhaust from the turbine portion of said turbomachinery means, means connecting the output of the second pass of said regenerator to the output of the evaporator for flow of said combined output to the compressor portion of said turbomachinery, and the compressor portion of said turbomachinery including means to remove a portion of the working fluid therein for flow to said condenser.

17. The system as set forth in claim 16 wherein said means to remove a portion of the working fluid from said compressor portion includes diffuser vanes means.

18. The system as set forth in claim 16 wherein said means to remove a portion of the working fluid from said compressor portion includes conical diffuser means.

19. The system as set forth in claim 1 wherein said turbomachinery means includes a compressor wheel and a turbine mounted on the same shaft for rotation within a housing, means to introduce said working fluid into said compressor for flow to said turbine, and ejector means receiving high pressure working fluid for mixture with the working fluid from said compressor for flow of the combined stream to said turbine wheel.

20. A method of heating and cooling comprising the steps of:

providing a supply of working fluid at a predetermined pressure and which changes phase at a predetermined temperature, expanding a first portion of said working fluid in liquid form to a pressure less than said predetermined pressure, effecting a change of phase of said working fluid at said temperatures to a gas whereby heat is absorbed from the surrounding environment to provide a cold air source for cooling and refrigeration thus forming a low energy working fluid component, increasing the pressure of another portion of said working fluid in liquid form to a pressure greater than said predetermined pressure, effecting a change of phase of said other portion of said working fluid at a pressure greater than said predetermined pressure to provide a working fluid in gas form and at a temperature above the temperature of said other gas and at a pressure above said predetermined pressure to form a high energy working fluid component, flowing said high and low energy working fluid components into a turbo-device for increasing the energy of said low energy component and decreasing the energy of said high energy component to provide an output of working fluid at an intermediate pressure line, and condensing said working fluid at said intermediate pressure line to a liquid.

21. The method as set forth in claim 20 wherein said condensing step provides heat for use as a space heater.

22. The method as set forth in claim 20 wherein said step of effecting change of phase of said other portion of said working fluid includes heating the same by an external heat source to change phase.

23. The method as set forth in claim 22 wherein said external heating source is waste heat.

24. The method as set forth in claim 20 wherein said working fluid at said pressure above said predetermined pressure is pre-heated prior to change of phase while at least a portion of the output of said turbo-device is cooled prior to condensation.

25. The method as set forth in claim 24 wherein the entire output of said turbo-device is cooled prior to condensation.

26. The method as set forth in claim 24 wherein said low energy working fluid is pre-heated prior to flow to said turbo-device.

27. The method as set forth in claim 20 wherein said turbo-device is a multi-stage turbo-device.

28. The method as set forth in claim 24 wherein a portion of the output of the turbo-device is cooled and admixed with said low energy component prior to flow into said turbo-device.

29. The method as set forth in claim 28 wherein another portion of the output of said turbo-device is condensed.

30. The method as set forth in claim 28 wherein said working fluid is selected from the group consisting of halogenated hydrocarbons and mixtures of carbon dioxide and hydrocarbon fluids.

* * * * *